United States Patent [19]

Snellgrove et al.

[11] Patent Number: 5,001,396

[45] Date of Patent: Mar. 19, 1991

[54] ARC TUBE AND HIGH PRESSURE DISCHARGE LAMP INCLUDING SAME

[75] Inventors: Richard A. Snellgrove, Danvers; Elliot F. Wyner, Peabody, both of Mass.

[73] Assignee: GTE Products Corporation, Danvers, Mass.

[21] Appl. No.: 423,484

[22] Filed: Oct. 11, 1989

Related U.S. Application Data

[63] Continuation of Ser. No. 193,988, May 13, 1988, abandoned.

[51] Int. Cl.[5] ..... H01J 61/36

[52] U.S. Cl. ..... 313/625; 313/623

[58] Field of Search ..... 313/624, 625, 623

[56] References Cited

U.S. PATENT DOCUMENTS

| | | | |
|---|---|---|---|
| 4,437,039 | 3/1984 | Larson | 313/625 X |
| 4,560,903 | 12/1985 | Sneijers et al. | 313/625 |
| 4,721,886 | 1/1988 | Oomen et al. | 313/625 |

*Primary Examiner*—Palmer C. DeMeo

*Attorney, Agent, or Firm*—Martha Ann Finnegan

[57] ABSTRACT

An arc tube including a tubular ceramic envelope; a chemical fill within the envelope; a seal button at each end of the envelope, the seal button having an aperture therethrough for receiving a feedthrough member; a feedthrough member having an electrode projecting therefrom passing through the seal button aperture and being oriented such that the electrode projects into the tubular ceramic envelope; frit material sealing the seal buttons into the ends of the envelope and the feedthrough members into the seal buttons; and means for interrupting the seal interface between the feedthrough member and the frit material around the total circumference of at least a portion of the feedthrough member. In a preferred embodiment of the present invention, the means for interrupting the seal interface includes a coating disposed around the periphery, or circumference, of the feedthrough member. Such coating comprises a material, most preferably a metal or metal alloy, which is inert to reaction with said frit material, the feedthrough member, and the fill gas components and which has a thermal expansion properties compatible with the thermal expansion properties of both the feedthrough member and the frit material. A high pressure metal vapor discharge lamp including the arc tube of the present invention is also provided.

20 Claims, 4 Drawing Sheets

ARC TUBE AND HIGH PRESSURE DISCHARGE LAMP INCLUDING SAME

This is a continuation of co-pending application Ser. No. 07/193,988, filed on May 13, 1988, and now abandoned.

TECHNICAL FIELD OF THE INVENTION

The present invention relates to arc tubes, and more particularly to arc tubes used in high pressure metal vapor discharge lamps.

BACKGROUND OF THE INVENTION

The arc tube for high pressure metal vapor discharge lamps, such as, for example, high pressure sodium (HPS) discharge lamps, typically comprises a tubular ceramic arc tube sealed at each end with a ceramic seal button. Such tubular ceramic arc tubes and seal buttons are typically fabricated from translucent polycrystalline alumina (PCA). Passing through the seal button is a feedthrough member, e.g., a tube or wire, which serves the function of electrical feedthrough and electrode holder. Feedthrough members typically comprise niobium or a mixture of metals such as, for example, niobium and zirconium. The feedthrough member and seal button component are typically held together by means of a sealing frit, normally including oxides of calcium and alumina. The sealing frit may further include oxides of barium, magnesium, boron, strontium, beryllium, and/or yttrium. The structure of a typical commercial arc tube embodying these basic features is well known in the lighting art.

The sealing frit employed in the arc tube of a high pressure metal vapor discharge lamp must have a composition which does not react with the components of the fill gas. Additionally, the thermal expansion coefficient of the sealing frit should be within certain tolerances of that of the ceramic arc tube material so that the sealing frit will not crack upon thermal cycling. For practical reasons, during sealing it is desirable to minimize the melting point of the frit.

High pressure metal vapor discharge lamps of the high pressure sodium type operate at seal temperatures of about 700° C. Although such lamp has very high luminous efficiency, the color of the light output is not satisfactory for many applications. Thus, there is a need to improve the color of such HPS lamps.

Because of the low color rendering index (CRI) and color temperature of HPS lamps, much research effort has been directed to improving the color of the lamp light output. One technique for improving color has been to increase the sodium pressure of the lamp which has the effect of increasing the overall CRI. Examples of this technology for lamps with a CRI of about 60 are described by Bhalla (J. Illuminating Engineering Society, Vol. 8, pp 202–206 (1979)). These lamps only increase the correlated color temperature of sodium lamps from about 2100° K. to about 2250° K. This small improvement in color temperature has not been of sufficient magnitude to compensate for other disadvantages associated with this technique. Thus, the resulting lamp has not been well received in the market. Another approach has been to raise the sodium pressure still further, which raises color temperature to about 2700° K., but the drop in efficacy for such a lamp is precipitous. To increase sodium pressure, the seal temperature must be increased. Sealing frits developed for this purpose are described in U.S. Pat. No. 4,501,799. These sealing frit materials have melting temperatures in excess of 1600° C. Such temperatures are much greater than those of conventional sealing frit materials which have melting temperatures of about 1250° C. Further, the rare earth elements included in these sealing frits cause these sealing frit materials to be more costly than standard frit materials including alkaline earth oxide components.

U.S. Pat. No. 4,409,517 issued to Van Der Sande et al. describes achieving improved color in discharge lamps employing ceramic arc tubes which include metal halide fills. To avoid the reaction of the halide components of the fill with a niobium feedthrough, Van Der Sande et al. teach applying a halide resistant coating to that portion of the upper inlead which is in contact with the lamp fill. The coating protects the in-lead from reaction with the halide vapors.

Another technique for improving the color of high pressure sodium discharge lamps is to include additional radiating elements in the fill. This technique was originally described in U.S. Pat. No. 3,521,108 issued to Hanneman. These lamps typically operate with seal temperatures about 1000° C. Such lamps often experience premature failure.

SUMMARY OF THE INVENTION

In accordance with the present invention, it has been found that the performance of arc tubes used in high pressure metal vapor discharge lamps is improved by creating an interruption, or break in the continuity of, the seal interface between the feedthrough member and the frit material around the total circumference of at least a portion of the feedthrough member. This interruption of the feedthrough member—frit interface inhibits, and advantageously prevents, formation of a continuous path through which fill gas contained in the arc tube can escape from the arc tube.

In accordance with one aspect of the present invention, there is provided an arc tube for a high pressure metal vapor discharge lamp comprising a ceramic arc tube envelope; a chemical fill within said envelope; a feedthrough member having an electrode projecting therefrom sealed into the end of the arc tube envelope such that the electrode attached thereto projects into the arc tube; means for sealing said arc tube envelope; and means for interrupting the seal interface between said feedthrough member and said frit material around the total circumference of at least a portion of the feedthrough member.

In accordance with a preferred embodiment of the arc tube of the present invention, said means for sealing said arc tube envelope comprises a seal button at each end of said envelope, said seal button having an aperture therethrough for receiving a feedthrough member and frit material sealing said seal buttons to the ends of said envelope and said feedthrough members into said seal buttons and/or the arc tube envelope.

In a preferred embodiment of the arc tube of the present invention, the means for interrupting the seal interface between said feedthrough member and said frit material around the total circumference of at least a portion of the feedthrough member comprises a coating disposed around the periphery of the feedthrough member. Such coating comprises a material, most preferably a metal or metal alloy, which is inert to reaction with said frit material, the feedthrough member, and the fill gas components during lamp operation and which has thermal expansion properties compatible with the thermal expansion properties of both the feedthrough member and the frit material.

In accordance with another aspect of the present invention, there is provided a high pressure metal vapor discharge lamp comprising: an outer glass envelope having electrical conductors sealed therein and passing therethrough, each of said electrodes being in electrical connection with an electrical conductor; an arc tube mounted within said outer glass envelope, said arc tube comprising a tubular ceramic envelope; a chemical fill within said envelope; a seal button at each end of said envelope, said seal button having an aperture therethrough for receiving a feedthrough member; a feedthrough member having an electrode projecting therefrom passing through said seal button aperture and being oriented such that the electrode projects into said tubular ceramic envelope; frit material sealing said seal buttons to the ends of said envelope and sealing said feedthrough members into said seal buttons; means for interrupting the seal interface between said feedthrough member and said frit material around the total circumference of at least a portion of the feedthrough member; and a lamp base.

For a better understanding of the present invention, together with other and further objects, advantages, and capabilities thereof, reference is made to the following disclosure and appended claims in connection with the above described drawings.

DETAILED DESCRIPTION

The conventional construction of the end seal of a ceramic arc tube for use in a high pressure metal vapor discharge lamp uses a feedthrough member sealed into the end structure of the ceramic arc tube with sealing frit material. In accordance with the present invention, it has been found that the performance of high pressure metal vapor discharge lamps is improved by including, in an arc tube for a high pressure metal vapor discharge lamp, means for interrupting the seal interface between said feedthrough member and said frit material around the total circumference of at least a portion of the feedthrough member.

In a preferred embodiment of the present invention, the means for interrupting the seal interface between said feedthrough member and said frit material around the total circumference of at least a portion of the feedthrough member comprises a coating disposed around the total periphery, or circumference, of at least a portion the feedthrough member. Such coating comprises a material, most preferably a metal or metal alloy, which is inert to reaction with the frit material, the feedthrough member, and the fill gas components during lamp operation and which has thermal expansion properties compatible with the thermal expansion properties of both the feedthrough member and the frit material.

Figure 1:
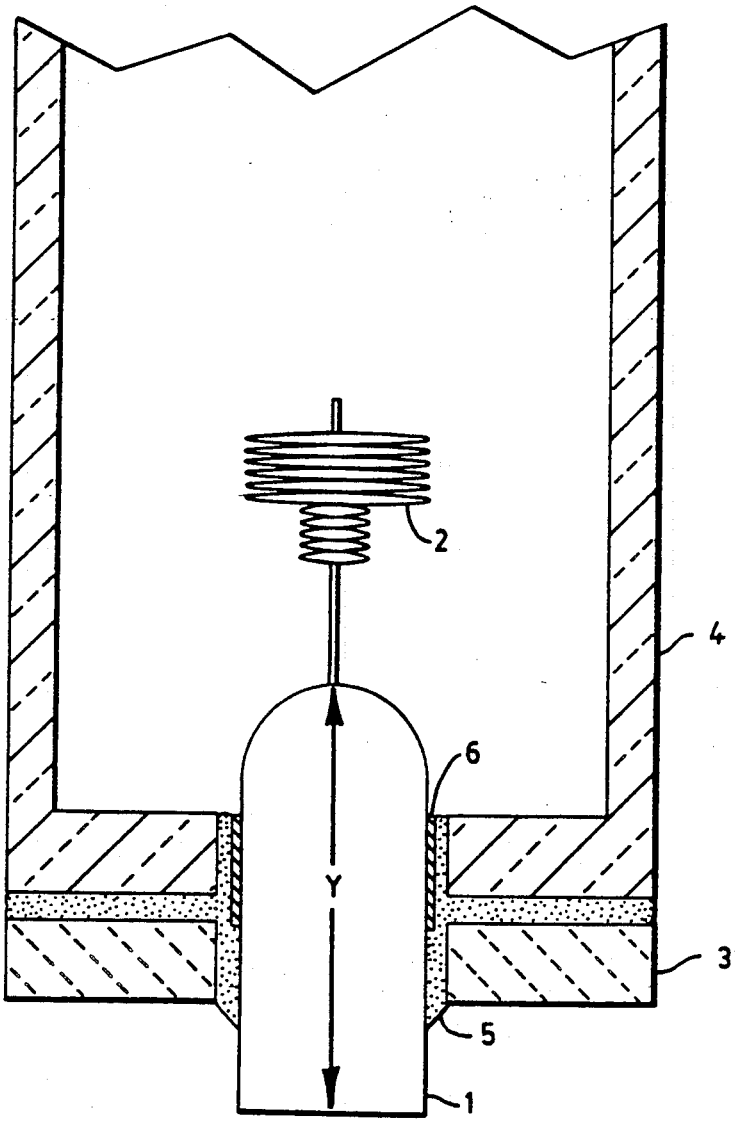
FIGS. 1-3 preferred embodiments of the end structures of arc tubes of the present invention.

In FIG. 1, there is shown, in cross section, the end structure of an arc tube of one embodiment of the present invention. The feedthrough member 1 having an electrode 2 mounted thereto is sealed into a ceramic seal button 3 with fused frit material 5. The seal button 3 and feedthrough member 1 are also sealed to the arc tube envelope 4 with fused frit material 5. The arc tube envelope comprises translucent ceramic such as polycrystalline alumina. The illustrated embodiment is of a monolithic construction design. Such monolithic design includes an end disk (or insert) sintered into the end of an open ceramic tube. The sintered boundary (joint) between the tube and disk may be hermetic. The monolithic envelope further includes an aperture at each end for receiving the feedthrough member. The arc tube may further comprise dopants such as yttria, magnesia, and/or lanthana. The seal button comprises a ceramic material such as, for example, polycrystalline alumina. The seal button may further comprise dopants such as yttria, magnesia, and/or lanthana.

In the embodiment of the present invention shown in FIG. 1, the means for interrupting the seal interface between said feedthrough member and said frit material around the total circumference of at least a portion of the feedthrough member comprises a coating disposed between said feedthrough member and said sealing frit material, said coating being disposed around the periphery of the feedthrough member. Such coating comprises a material which is inert to reaction with the frit material, the feedthrough member, and the fill gas components during lamp operation and which has thermal expansion properties compatible with those of the materials the coating is in contact with. In a most preferred embodiment, the coating comprises molybdenum.

The coating disposed on the outer surface of the feedthrough member, as shown in cross-section in FIG. 1, forms a break, or discontinuity, in the seal interface between the feedthrough member and the frit material along the length dimension Y of the feedthrough member. The break in the seal interface occurs around the outer perimeter of the feedthrough member. In other words, in the embodiment shown in FIG. 1, the coating comprises a band of coating material disposed between the feedthrough member and the frit material and around the circumference of the feedthrough member.

The arc tube shown in FIG. 1 is of a monolithic design.

Figure 2:
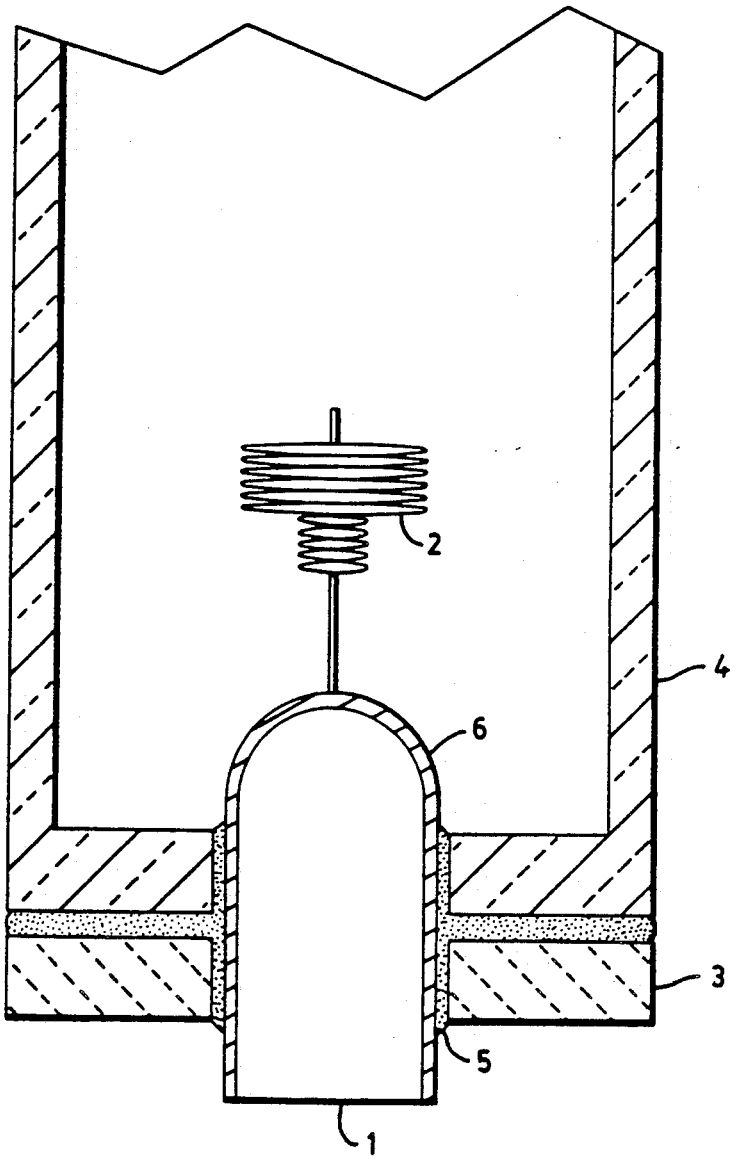
Figure 3:
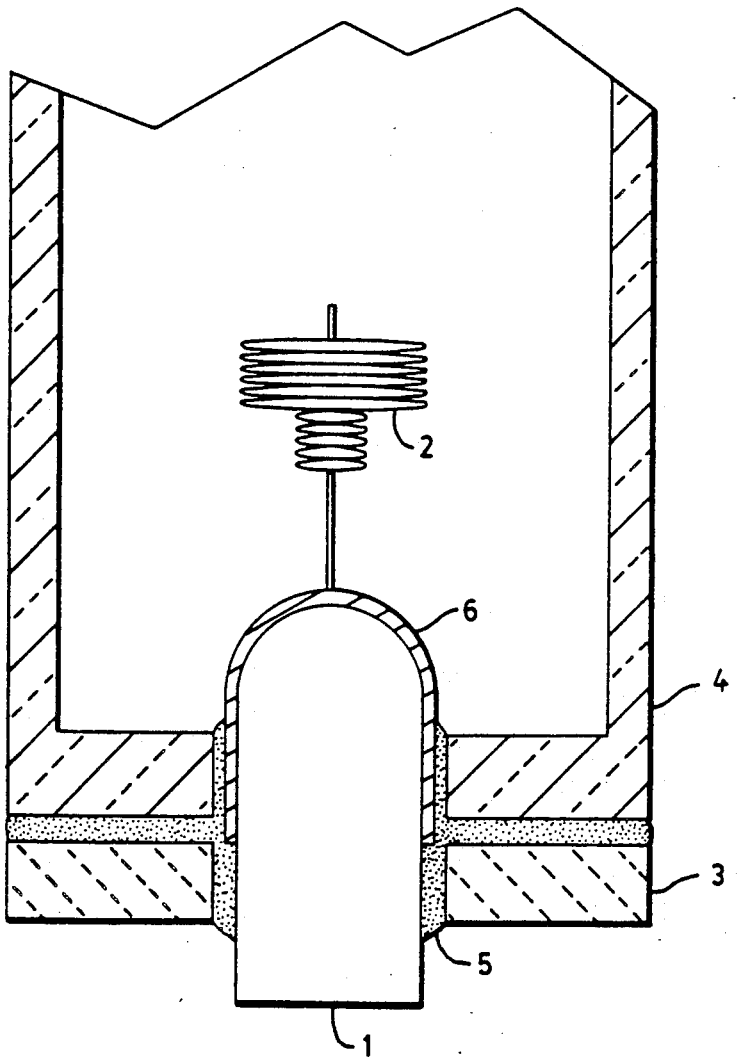

While the arc tube shown in FIGS. 1-3 is of a monolithic design, the present invention is also advantageous when included in arc tubes fabricated using the hat or disk design. Such arc tube designs are well known to those in the lighting art. Examples of such designs are illustrated in FIGS. 1*b*, *c*, of, and described in, U.S. Pat. No. 4,713,580 to Schoene, which is hereby incorporated herin by reference. In such alternative arc tube designs, the seal button may further be of a hat design.

FIG. 2 illustrates an alternative embodiment of the present invention. In FIG. 2, there is shown, in cross-section, the end structure of an arc tube of an alternative embodiment of the present invention. The feedthrough member 1 having an electrode 2 mounted thereto is sealed into a ceramic seal button 3 and the arc tube 4 with fused frit material 5. Fused frit material 5 also seals the ceramic seal button 3 to the arc tube envelope 4. As in FIG. 1, the embodiment of the present invention shown in FIG. 2 includes means for interrupting the seal interface between said feedthrough member and said frit material around the total circumference of at least a portion of the feedthrough member. The interruption means shown in FIG. 2 comprises a coating 6 disposed between the feedthrough member and the sealing frit material and around the total circumference of at least a portion of the feedthrough member. In the embodiment shown in FIG. 2, the coating is further disposed over the entire outer surface of the niobium feedthrough member. The coating shown in FIG. 2 interrupts the seal interface between the feedthrough member and the frit material and also protects the portion of the feedthrough extending into the arc tube interior from reaction with the fill gas components.

FIG. 3 illustrates a still further alternative embodiment of the present invention. In FIG. 3, there is shown, in cross-section, the end structure of an arc tube of one embodiment of the present invention. The feedthrough member 1 having an electrode 2 mounted thereto is sealed into a ceramic seal button 3 and the arc tube envelope 4 with fused frit material 5. Fused frit material 5 also seals the ceramic seal button 3 to the arc tube 4. As in FIGS. 1 and 2, the embodiment of the present invention shown in FIG. 3 includes means for interrupting the seal interface between said feedthrough member and said frit material around the total circumference of at least a portion of the feedthrough member comprising a coating 6 disposed around the periphery of the feedthrough member between the feedthrough member and frit material.

The coating disposed on the outer surface of the feedthrough member, as shown in cross-section in FIG. 3, interrupts the direct seal interface between the feedthrough member and frit material around at least a portion of the periphery of the feedthrough member. In the embodiment shown in FIG. 3, the coating is further disposed over the portion of the surface of the feedthrough member projecting from the seal area and into the arc tube.

The present invention is particularly advantageous for use in ceramic arc tubes containing fills which cause a high pressure metal vapor discharge lamp to operate at temperatures greater than or equal to about 900° C., which is higher than the operating temperatures of typical HPS lamps. Such higher temperatures include temperatures from about 900° to about 1100° C., or higher. Heretofore conventionally fabricated high pressure metal vapor discharge lamps of the high pressure type operating at such high temperatures undergo a variety of undesirable reactions leading to lamp failure.

The present work has revealed that sealing material (also referred to herein as frit material or frit) composed of the oxides of aluminum, calcium, magnesium, barium, and boron can react with the niobium feedthrough to form a reaction zone of three layers: (1) calcium aluminum niobium oxide (next to the frit); (2) niobium boride; and (3) calcium magnesium niobium oxide (adjacent to and derived from the feedthrough member). Failure of the seal is believed to occur at the poorly bonded interface joining the latter two layers. Borate is the seal component which is believed to be responsible for supplying the oxygen to oxidize the feedthrough material. The present work has also shown that, in the absence of boron, the alumina and alkaline earth oxide components of the frit can be reduced by the feedthrough member. This loss of alumina combined with the volatilization of other components of the sealing material is believed to produce a gap at the interface which grows until hermeticity is lost. The conclusions set forth in this paragraph represent the theory underlying the present invention and is not intended as a limitation on the scope thereof.

The present invention is particularly advantageous for arc tubes including a sealing frit material comprising, prior to sealing, 45.6% $Al_2O_3$, 39.0% CaO, 8.6% BaO, 5.2% MgO, and 1.6% $B_2O_3$ (hereinafter referred to as type F frit), or a sealing frit material comprising, prior to sealing, 47.0% $Al_2O_3$, 37.0% CaO, and 16.0% BaO (hereinafter referred to as type G frit). The percentages referred to in the foregoing compositions represent weight percent values. After being subjected to seal forming temperatures, the composition of a completed seal is enriched in alumina.

The following Examples are given to enable those skilled in the art to more clearly understand and practice the present invention. The Examples should not be considered as a limitation upon the scope of the invention but merely as being illustrative thereof.

EXAMPLE 1

A ceramic arc tube including a molybdenum coating having a thickness of about 100 micrometers on the inner end of the feedthrough member (also referred to herein as the in-lead) (see FIG. 3) was filled with a fill comprising 150 mg Tl, 30 mg Cd, and 40 torr Ar, and sealed with Type F frit. This arc tube was placed inside an evacuated quartz tube within a tube furnace and heated so that one of the seals of the arc tube was kept at 940° C. and the other was kept at 960° C. No leakage of fill was observed in 1514 hours at temperature (the arc tube was cooled to room temperature and reheated to the aforementioned temperatures 22 times during this period).

Four control arc tubes were fabricated and tested in a manner similar to that described above, except that the arc tubes of the control experiments did not include a molybdenum coating on the in-lead. The control arc tubes began to leak fill after an average of only 120 hours of testing. After 300 hours, all of the control arc tubes had lost at least 20% of their metallic fill.

EXAMPLE 2

A second set of experiments was carried out involving seven arc tubes. Four of the arc tubes had a plasma sprayed molybdenum coating applied to the feedthrough member as shown in FIG. 3. The coating applied in this set of experiments had a coating thickness of about 100 micrometers. The remaining three arc tubes did not include a coating on the feedthrough member. The arc tubes included a fill comprising of 0.3 mg Na, 8.8 mg Hg, 82 mg Cd, and 16 mg Tl with a xenon starting gas pressure of 40 torr (5.3 KPa). The arc tubes were 9.8 mm I.D./11.7 mm O.D. with a 54 mm cavity length. The lamps were nominal 250 watt and could be operated using a standard HPS ballast. The ends of the arc tubes were all enclosed with heat insulating materials so as to raise the seal temperature to 950° C.-1000° C.

At 440 hours, one of the arc tubes with an uncoated niobium feedthrough had leaked. The jacket was plated with metal fill and contained the starting gas that had been within the arc tube. At the time this observation was made, one of the lamps with coated in-leads was dropped, destroying the lamp. The outer jacket of this lamp was observed to be clear.

At 500 hours the two remaining controls had plated jackets and were not serviceable as lamps. The arc tubes in accordance with the present invention, including the molybdenum coating on the feedthrough member as shown in FIG. 3, were either clear or had very light browning. The aging of these lamps was continued with progressively increasing darkening of the inner wall of the outer jacket, but these lamps did not become unserviceable, as characterized by an opaque plating of their jacket and leakage of the starting gas, until 2035 hours, 2080 hours, and 2879 hours.

EXAMPLE 3

A third set of experiments was carried out involving three control lamps and three lamps including a molybdenum coating on the feedthrough member as shown in FIG. 3. The lamps used in this third set of experiments were fabricated in a manner similar to that described in Example 2, with the exception that one of the lamps including a molybdenum coating had the sodium and mercury dosing increased to 0.6 mg and 11 mg, respectively.

By 1200 hours, two of the controls exhibited a heavy plating of metal on the inner surface of the outer jacket; the other control exhibited light. darkening; and all of the lamps in accordance with the present invention exhibited only light darkening.

EXAMPLE 4

A fourth set of experiments was carried out using lamps which were fabricated by a method similar to that described in Example 2, with the exception that in the lamps embodying present invention, the molybdenum coating was applied only opposite the insert button as illustrated in FIG. 1. This series included six arc tubes made with alumina coating on the niobium, four with a molybdenum coating, and four controls (i.e., no coating on the feedthrough member). By 1400 hours, all of the control lamps had leaked; all lamps including an alumina coating on the feedthrough exhibited also leaking of the fill gas from the arc tube; and one of the lamps including the molybdenum coating exhibited leaking of the fill gas from the arc tube into the outer jacket.

In the above test the coatings were applied by plasma spray. Analysis of the failed lamps in this set of experiments which included a coating on the feedthrough member indicated that the failure in each instance occurred due to failure of the monolithic joint. There was no evidence of deterioration of the seal surrounding the coated portion of the feedthrough member. Reaction, however, did occur at direct frit material-feedthrough member interfaces. It is believed that this failure mode could be eliminated with hermetic end buttons.

EXAMPLE 5

A fifth set of experiments was carried out involving lamps fabricated by a method similar to that described in Example 2 with the exception that the arc tube dimensions were slightly increased, to 10.3 mm/12.3 mm I.D./O.D. and 57 mm cavity length. Coatings of molybdenum were applied by vacuum deposition thereby producing a thinner coating than was formed using plasma spray. In this set of experiments, the entire feedthrough member was coated with the coating (as shown in FIG. 2). All of the lamps tested in this set of experiments included a coating on the entire outer surface of the feedthrough. No control lamps were made and tested in this experimental series. Of the six lamps made and tested in this set of experiments, four have survived to 6000 hours with some darkening of the outer jacket. The two lamps that have failed were of a thinner coating, i.e., about 1 micrometer, as compared to the lamps that have survived which included a coating having a thickness of about 2 micrometers. Analysis of seals from failed arc tubes indicated diffusion of niobium through the coating.

In the embodiments of the present invention described in the foregoing examples, the feedthrough member-frit interface has been interrupted around the total circumference of at least a portion of the feedthrough member by the use of a coating comprising molybdenum. Coatings of other materials having thermal expansion properties compatible with those of the ceramic arc tube components, sealing frit material, and feedthrough member so as not to result in cracking or separation of the coating and which are less reactive than niobium with the sealing frit material and inert to reaction with the feedthrough member to the extent that the coating interruption is not compromised at lamp operating temperatures may be used in place of molybdenum. The coating material preferably does not react with the components of the fill gas to the extent that lamp operating characteristics, e.g., voltage, color properties, efficacy, etc., are adversely affected. Such coating material preferably has a vapor pressure less than 0.1 torr at 1,000° C. and a melting point greater than 1,000° C. Examples of such metals including, for example, tungsten and iridium, may also be effective. It is further understood that the thickness of the coating must be controlled to have a thickness of at least about 2 micrometers. The coating thickness is preferably less than the thickness at which thermal expansion coefficient mismatch between the coating and adjacent arc tube components causes cracking or separation of the coating. Most preferably, the thickness of the coating is from about 2 to about 150 micrometers.

The arc tube of the present invention can be used in high pressure metal vapor discharge lamps of the high pressure sodium type, of the high pressure mixed metal vapor type, or of the high pressure metal halide type. The details of the construction of these various types of lamps are well known to the artisan having ordinary skill in the lighting art.

Figure 4:
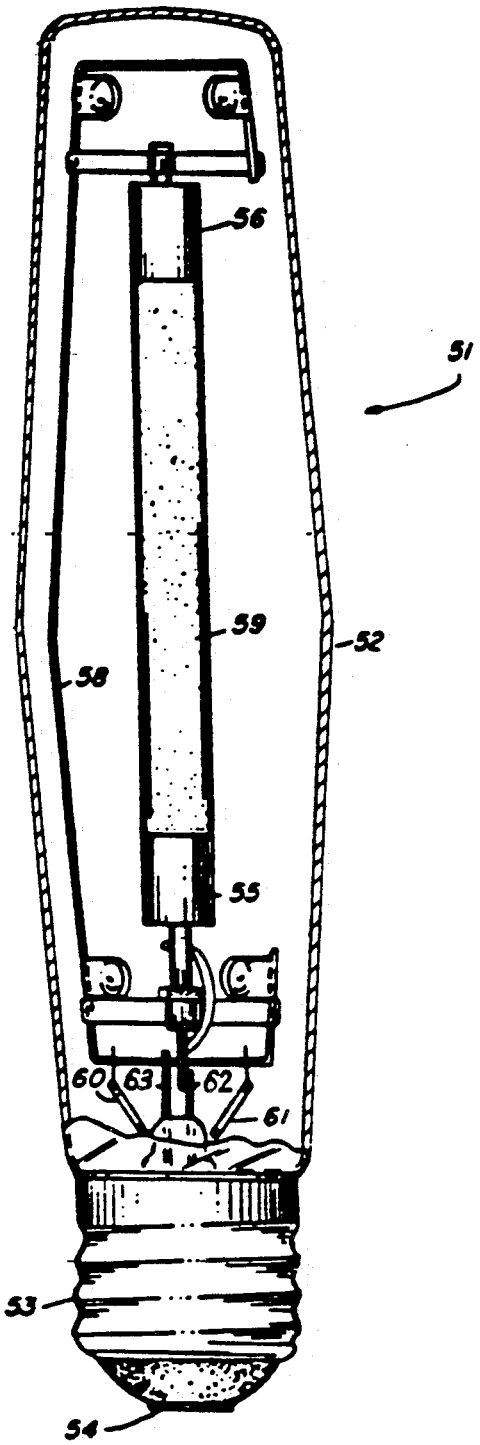
FIG. 4 illustrates an example of the structure of a high pressure metal vapor discharge lamp.

FIG. 4 illustrates an example of a high pressure metal vapor discharge lamp of the high pressure sodium type to which the invention is applicable. The lamp 51 comprises an arc tube 59 supported within an evacuated outer vitreous glass envelope 52, for example, borosilicate glass, having means for electrically coupling the lamp with a power source (not shown), such as a lamp base 53 with a terminal 54. Electrical conductors 62, 63 are sealed within and pass through the outer envelope to provide electrical connections from the interior to the exterior of the glass envelope. The arc tube 59 containing a fill comprising sodium, mercury, and a rare gas is supported within the outer envelope 52 by support means 58 such as a metallic frame in a well known manner. The rare gas acts as a starting gas and the mercury acts as a buffer gas to raise the gas pressure and operating voltage of the lamp to a practical level. Heat conserving means 55, 56, may surround the arc tube 59 at each end thereof in the vicinity of the electrodes (not shown), in order to reduce the heat differential thereat from the center of the arc tube.

Each end of the arc tube includes means for interrupting the seal interface between said feedthrough member and said frit material around the total circumference of at least a portion of the feedthrough member. The seal is formed from seal means comprising fused seal material, such as melted (or fused) glass ceramic frit.

The sealing frit material can be any of the sealing frit materials typically used in the fabrication of arc tubes for high pressure sodium vapor discharge lamps, such as, for example, an alkaline-earth based seal material including $Al_2O_3$, CaO and BaO with replacements or additions of SrO, $Y_2O_3$, $La_2O_3$, MgO, and/or $B_2O_3$.

A high pressure metal vapor discharge lamp in accordance with an embodiment of the present invention may be of a saturated or unsaturated vapor type. The amounts of sodium and mercury required to dose either saturated or unsaturated type high pressure sodium lamps are known to those skilled in the art.

Most high pressure sodium discharge lamps can operate in any position. The burning position has no significant effect on light outputs. A high pressure sodium discharge lamp may further include diffuse coatings on the inside of the outer bulb to increase source luminous size or reduce source luminance. The outer envelope may further include getters, 60, 61.

While there has been shown and described what are considered preferred embodiments of the present invention, it will be obvious to those skilled in the art that various changes and modifications may be made therein without departing from the invention as defined by the appended claims.

What is claimed is:

1. An arc tube for a high pressure metal vapor discharge lamp comprising:

a ceramic arc tube envelope;

a chemical fill disposed within said envelope;

a seal button at each end of said envelope, said seal button having an aperture therethrough for receiving a feedthrough member;

a tubular feedthrough member having a circumference and having an electrode projecting therefrom, said feedthrough member passing through said seal button aperture and being oriented such that the electrode projects into said envelope;

frit material sealing said seal buttons into the ends of the envelope and said feedthrough member into said seal buttons; and means for interrupting the seal interface between said feedthrough member and said frit material around the total circumference of at least a portion of the feedthrough member, said means comprising a metal-containing coating disposed around the circumference of at least a portion of the feedthrough member.

2. An arc tube in accordance with claim 1 wherein said fill comprises sodium, mercury, and a starting gas.

3. An arc tube in accordance with claim 1 wherein said fill comprises sodium, mercury, a starting gas, and elemental radiating species.

4. An arc tube in accordance with claim 1 wherein said fill comprises mercury, metal halide additives, and a starting gas.

5. An arc tube in accordance with claim 1 wherein said coating comprises molybdenum.

6. An arc tube in accordance with claim 1 wherein said coating comprises a material which is inert to reaction with said frit material, the feedthrough member, and the fill gas components during lamp operation and which has thermal expansion properties compatible with the thermal expansion properties of the feedthrough member and the frit material.

7. An arc tube in accordance with claim 1 wherein said coating has a thickness of at least about 2 micrometers and no greater than that thickness at which mismatch between the thermal expansion coefficient of the coating and the thermal expansion coefficients of the sealing frit material and feedthrough member causes breaks in the coating.

8. An arc tube in accordance with claim 7 wherein said coating comprises molybdenum.

9. An arc tube in accordance with claim 8 wherein said coating thickness is from about 2 to about 150 micrometers.

10. An arc tube in accordance with claim 1 wherein said frit material comprises, prior to sealing, $Al_2O_3$, CaO, BaO, MgO, and $B_2O_3$.

11. An arc tube in accordance with claim 10 wherein said frit material comprises, prior to sealing, 45.6% $Al_2O_3$, 39.0% CaO, 8.6% BaO, 5.2% MgO, and 1.6% $B_2O_3$.

12. An arc tube in accordance with claim 1 wherein said frit material comprises, prior to sealing, $Al_2O_3$, CaO, and BaO.

13. An arc tube in accordance with claim 12 wherein said frit material comprises, prior to sealing, 47.0% $Al_2O_3$, 37.0% CaO, and 16.0% BaO.

14. An arc tube in accordance with claim 1 wherein said coating has a thickness of at least about 2 micrometers.

15. An arc tube in accordance with claim 1 wherein the coating comprises a material having a vapor pressure less than 0.1 torr at 1,000° C. and a melting point greater than 1,000° C.

16. An arc tube in accordance with claim 1 wherein said coating is applied to the feedthrough member by vacuum deposition or plasma spraying.

17. An arc tube in accordance with claim 16 wherein said coating consists essentially of molybdenum, tungsten, or iridium.

18. An arc tube in accordance with claim 1 wherein said sealing frit material, prior to sealing, consists essentially of one or more oxide compounds selected from the group consisting of $Al_2O_3$, CaO, BaO, SrO, $Y_2O_3$, $La_2O_3$, MgO, $B_2O_3$, and mixtures thereof.

19. A high pressure metal vapor discharge lamp comprising:

an outer glass envelope having electrical conductors sealed therein and passing therethrough, each of said electrodes being in electrical connection with an electrical conductor;

an arc tube mounted within said outer glass envelope, said arc tube comprising:

a tubular ceramic envelope;

a chemical fill within said envelope;

a seal button at each end of said envelope, said seal button having an aperture therethrough for receiving a feed through member;

a feedthrough member having an electrode projecting therefrom passing through said seal button aperture and being oriented such that the electrode projects into said tubular ceramic envelope;

frit material sealing said seal buttons to the ends of said envelope and sealing said feedthrough members into said seal buttons; and means for interrupting the seal interface between said feedthrough member and said frit material around the total circumference of at least a portion of the feedthrough member, said means comprising a metal-containing coating disposed around the circumference of at least a portion of the feedthrough member; and a lamp base joined to the envelope to electrically couple the lamp to a power source.

20. An arc tube for a high pressure metal vapor discharge lamp consisting:

ceramic arc tube envelope;

a chemical fill within said envelope;

a feedthrough member having an electrode projecting therefrom sealed into the end of the arc tube envelope such that the electrode attached thereto projects into the arc tube;

means for sealing said arc tube envelope; and means for interrupting the seal interface between said feedthrough member and said frit material around the total circumference of at least a portion of the feedthrough member, said means comprising a coating comprising a metal disposed around the circumference of at least a portion of the feedthrough member.

* * * * *